US005514421A

United States Patent [19]

Pietrzykowski et al.

[11] Patent Number: 5,514,421

[45] Date of Patent: May 7, 1996

[54] AIRFOIL AIR RING

[75] Inventors: Stanley J. Pietrzykowski, Rochester; Edward C. Williams, Palmyra; Robert W. Hedrick, Spencerport, all of N.Y.; William H. Gilbert, deceased, late of Rochester, N.Y., by Leon Katzen, executor

[73] Assignee: Xerox Corporation, Stamford, Conn.

[21] Appl. No.: 371,312

[22] Filed: Jan. 11, 1995

Related U.S. Application Data

[63] Continuation of Ser. No. 188,859, Jan. 31, 1994, abandoned.

[51] Int. Cl.[6] ..... B05D 1/18

[52] U.S. Cl. ..... 427/430.1; 427/348; 118/63; 118/425

[58] Field of Search ..... 427/348, 430.1; 118/63, 425

[56] References Cited

U.S. PATENT DOCUMENTS

| | | | |
|---|---|---|---|
| 3,877,975 | 4/1975 | Raymond | 427/433 |
| 3,968,279 | 7/1976 | Brown et al. | 427/348 |
| 4,083,323 | 4/1978 | Rote | 118/425 |
| 4,543,314 | 9/1985 | Maxwell | 430/134 |
| 4,943,447 | 7/1990 | Nelson et al. | 427/55 |
| 4,975,352 | 12/1990 | Anayama et al. | 430/135 |
| 5,298,292 | 3/1994 | Dilko et al. | 427/543 |

FOREIGN PATENT DOCUMENTS 2237196 9/1990 Japan .

*Primary Examiner*—Shrive Beck
*Assistant Examiner*—David M. Maiorana
*Attorney, Agent, or Firm*—John S. Wagley

[57] ABSTRACT

An apparatus for applying a coating solution to at least a portion of a substrate surface to form a coated surface comprises an arrangement for separating the substrate from the coating solution and an arrangement for creating a flow of gas onto the coated surface in a direction substantially parallel to the coated surface substantially in unison with the separating arrangement separating the substrate from the coating solution.

20 Claims, 4 Drawing Sheets

AIRFOIL AIR RING

This is a continuation of application Ser. No. 08/188,859, filed Jan. 31, 1994, now abandoned.

The present invention relates to a method and apparatus for manufacturing drum and flexible belt charge receptors for photocopiers. More particularly, the invention relates to an efficient method and a modular thermal circumference dryer for processing cylindrical or belt-like substrates to apply a coating material to the substrate.

A photoreceptor is a cylindrical or belt-like substrate used in a xerographic apparatus. The photoreceptor substrate is coated with one or more layers of a photoconductive material, i.e., a material whose electrical conductivity changes upon illumination. In xerographic use, an electrical potential is applied across the photoconductive layer and then exposed to light from an image. The electrical potential of the photoconductive layer decays at the portions irradiated by the light from the image, leaving a distribution of electrostatic charge corresponding to the dark areas of the projected image. The electrostatic latent image is made visible by development with a suitable powder. Better control of the coating quality yields better imaging performance.

One method of coating substrates is to dip the substrate in a bath of the coating material. This method is disadvantageous because it usually results in a non-uniform coating. In particular, when the substrate is oriented vertically and dipped into a bath, the coating thickness tends to "thin" or decrease at the top of the substrate and "slump" or increase at the base of the substrate due to gravity induced flow of the coating material as the substrate is lifted from the bath. Thickness variations also occur even when the photoreceptor is oriented horizontally and dipped into the bath due to the formation of a meniscus as the substrate is removed from the bath. This variation in coating thickness causes variations in the performance of the photoreceptor.

In another method, an air assisted automatic spray gun uses high velocity air to atomize the coating formulation which is sprayed onto a substrate. Due to high mass transfer rates intrinsic to the use of atomizing air, this method entails considerable evaporative loss of solvent from the spray droplets and requires the use of slow evaporating solvents to prevent excessive solvent loss before the droplets arrive at the substrate. It is difficult to use this method in a sealed environment, and thus difficult to control the solvent humidity surrounding the substrates prior to, during, or after the coating process. In addition, the air atomized spray method creates a considerable amount of overspray which results in higher material usage.

The following disclosures may be relevant to various aspects of the present invention:

U.S. Pat. No. 4,975,352
Patentee: Anayama et al.
Issue Date: Dec. 4, 1990

U.S. Pat. No. 4,543,314
Patentee: Maxwell
Issue Date: Sep. 24, 1985

U.S. Pat. No. 4,943,447
Patentee: Nelson et al
Issue Date: Jul. 24, 1990

U.S. patent application Ser. No. 07/891,091
Patentee: Dilko, et al.
Filed Jun. 1, 1992

U.S. patent application Ser. No. 07/995,491
Patentee: Pietrzykowski, et al.
Filed Dec. 23, 1992

The relevant portions of the foregoing disclosures may be briefly summarized as follows:

U.S. Pat. No. 4,975,352 to Anayama et al. discloses an electrophotographic photosensitive member comprising a conductive support, and having thereon a charge generation layer formed by coating, and then followed by drying, and further comprising a charge transport layer formed by coating, and then followed by drying. The patent states that the drying process is carried out by heating a freshly dipped cylinder at 80° C. for 10 minutes.

U.S. Pat. No. 4,543,314 to Maxwell discloses a process for preparation of an electrostatographic photosensitive device comprising: (1) combining a sodium additive with trigonal selenium particles, an organic resin binder and a solvent for the binder to form a milling mixture, (2) milling the mixture to form a uniform dispersion, (3) applying the dispersion to a substrate, and (4) drying the layer. The patent states that in the prior art the trigonal selenium layer can be dried at 60° C. in a forced air oven for 18 hours, and discloses that conventional drying methods can be employed such as oven drying, radiant heat drying, forced air drying and the like.

U.S. Pat. No. 4,943,447 to Nelson et al. discloses a process for heat treating a coating applied to an automobile body which is carried out with an apparatus comprising radiant heating elements for generating radiant heat in a predetermined path and convection heating elements for generating a flow of heated air.

U.S. patent application Ser. No. 07/891,091 filed Jun. 1, 1992 and assigned to the assignee of this application, discloses an apparatus for applying a coating solution onto a substrate to form a coated portion thereon including a dipping device for dipping and removing the substrate into and from the coating solution; and a heating device for inductively heating the substrate while the dipping device removes the substrate from the coating solution to uniformly dry an inner surface of the coated portion, the inner surface being adjacent to the substrate. This apparatus may advantageously include a drying device for blowing hot gases onto the coated portion of the substrate while the dipping device removes the substrate from the coating solution.

U.S. patent application Ser. No. 07/995,491 filed Dec. 23, 1992 and assigned to the assignee of this application, discloses a dip coat process material handling system and method for coating multiple layers of materials on a plurality of workpieces. A plurality of pipes are suspended from a carrier pallet which transports the workpieces through a dip coat cell housing various dip coat stations.

In accordance with one aspect of the present invention, there is provided an apparatus for applying a coating solution to at least a portion of a substrate surface to form a coated surface. The apparatus comprises means for separating the substrate from the coating solution. Means are provided for creating a flow of gas onto the coated surface in a direction substantially parallel to the coated surface substantially in unison with said separating means separating the substrate from the coating solution.

In accordance with another aspect of the present invention, there is provided an apparatus for applying a coating solution to at least a portion of a substrate surface. The apparatus comprises means for reciprocating the substrate in a substantially vertical direction into and out of the coating solution. Means are provided for creating a flow of gas onto the coated surface. The creating means comprises a conduit having an inner surface in confronting relationship with the substrate. The inner surface defines an aperture. The conduit is arranged so that a plurality of gas streams flowing through the aperture impinge and exert a gas pressure on the coated surface. The aperture is arranged so that a collective gas pressure from all gas streams is uniformly applied across the coated surface along a slightly transverse direction, transverse to the vertical direction and generally upwardly. Therefore, the coated surface is squeezed to a uniform thickness as reciprocating means remove the substrate and excess coating solution is blown upwardly in the vertical direction.

In accordance with further aspect of the present invention, there is provided a method for applying a coating solution to at least a portion of a substrate to form a coated surface. The method comprises the steps of dipping the substrate into the coating solution, removing the substrate from the coating solution, and creating a flow of gases onto the coated surface of the substrate substantially parallel to the substrate, while the substrate is being removed from the coating solution.

In accordance with further aspect of the present invention, there is provided a method for applying a coating solution onto a substrate to form a coated surface. The method comprises the steps of dipping the substrates into the coating solution, removing the substrate from the coating solution in a removing direction, and creating a flow of gases onto the coated surface. The flow squeezes the coated surface to a uniform thickness while the substrate is being removed. The gases form a collective pressure which is uniformly applied across the coated surface along a partially transverse direction transverse to the removing direction and a direction substantially parallel to the coated surface.

BRIEF DESCRIPTION OF THE DRAWINGS

The invention will be described in detail herein with reference to the following figures in which like reference numerals denote like elements and wherein.

The invention will be described in relation to the fabrication of cylindrical and belt-like substrates, and particularly rigid cylindrical drum and flexible belt photoreceptor substrates for photocopiers. The invention, however, is applicable to other coated substrates and/or coating processes.

Figure 1:
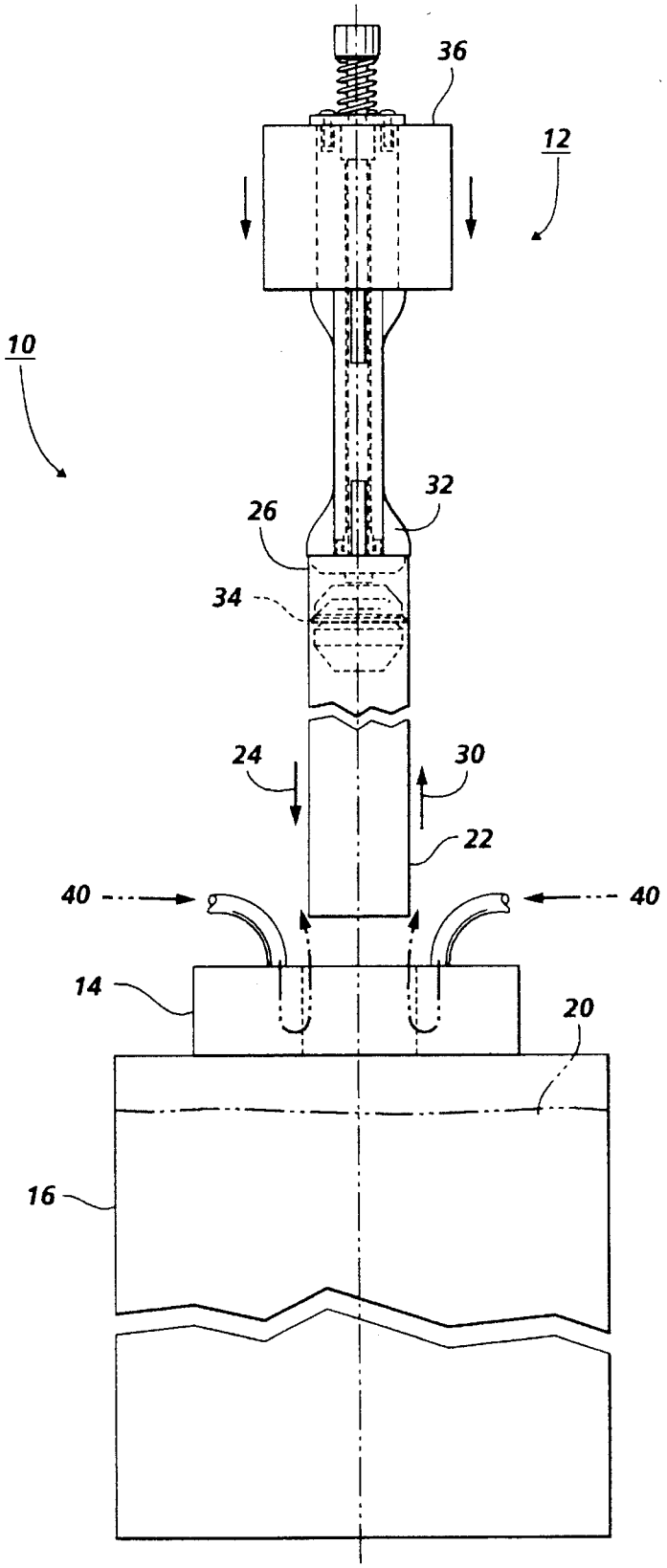
FIG. 1 is an elevational view of a manufacturing apparatus of the present invention.

First referring to FIG. 1, coating apparatus 10 includes dipping device 12, blowing device 14 and tank 16 for holding coating solution 20. The article to be coated such as substrate 22 is moved by dipping device 12 in a dipping direction 24 through blowing device 14 so as to be dipped in coating solution 20. After being dipped for a prescribed time according to the nature of the coating solution 20 and the desired properties of a coated layer 26 to be coated on substrate 22, dipping device 12 removes substrate 22 from coating solution 20 through blowing device 14 in a removing direction 30 opposite to dipping direction 24.

The dipping device 12 preferably comprises a mandrel 32 which supports a chucking device 34 which expands into the substrate 22. The mandrel 22 is preferably supported by carrier pallet 36 which will be discussed in more detail later. It should be appreciated that the dipping device 12 may take any suitable form such as a pliable member which fits into the substrate or tongs or any suitable holding apparatus suspended from a shaft or member. The member may be raised or lowered by any suitable means such as manually, by a manual or power chainfall, by a cylinder or other powered apparatus, or by a robot.

The blowing device 14 preferably comprises a blower 40 which is attached to a directing device 42. Preferably the blower 40 comprises a compressed air supply such as shop air supplied to a factory from stationary electric air compressors, not shown. It should be understood that the blower 40 may take any suitable form such as a manual fan or electric fan, a turbine, a compressed air cylinder, or a gas cylinder. The directing device 42 preferably comprises an annular hollow conduit which will be discussed in more detail later, but may take any suitable form such as a molded, formed, machined or cast nozzle, a hose, or a duct.

While the coating apparatus 10 as shown in FIG. 1 shows the substrate 22 in a cylindrical form, is should be appreciated that the invention may be practiced with the substrate in another form such as a flat sheet (not shown).

Figure 2:
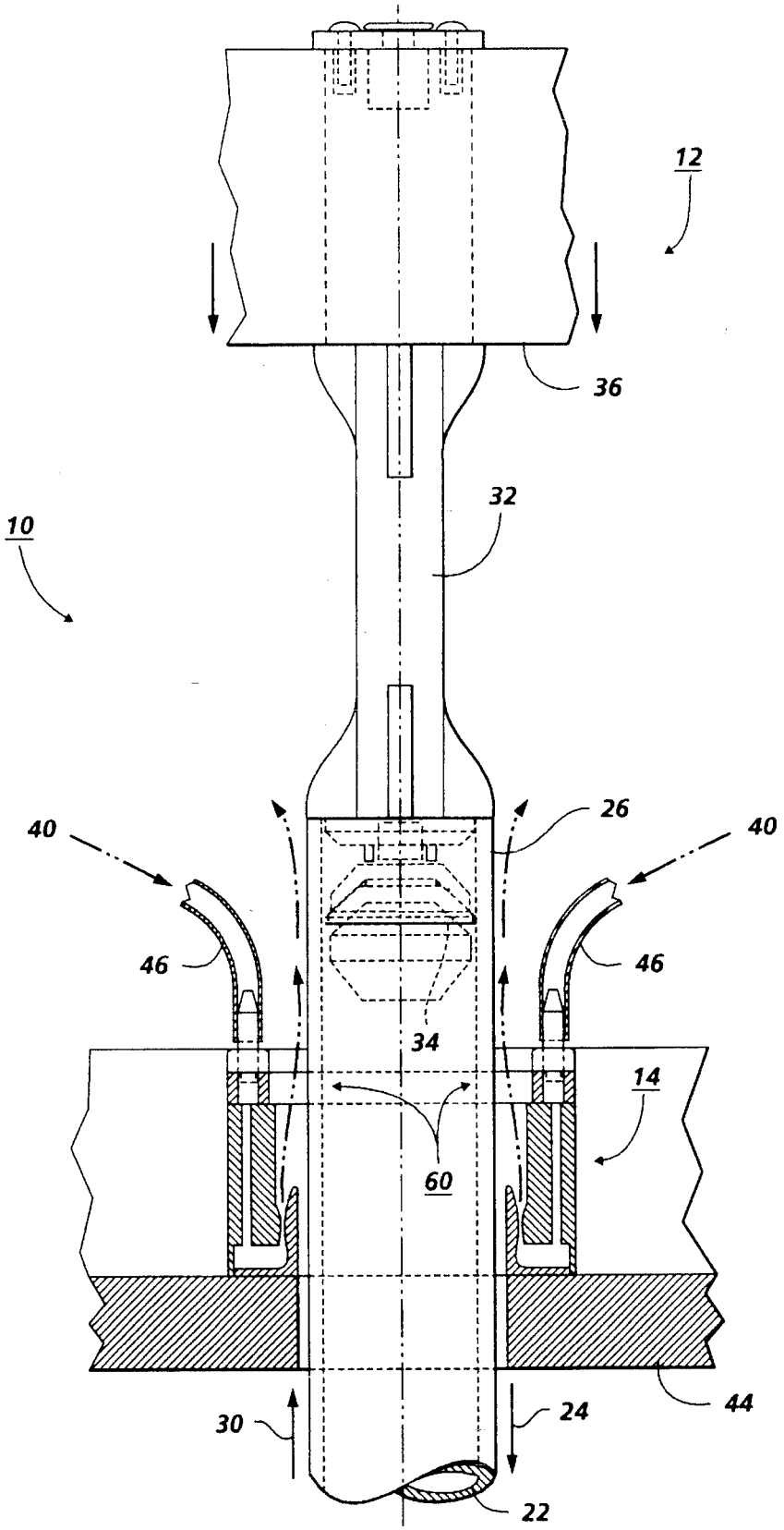
FIG. 2 is a partial elevational view of the manufacturing apparatus of FIG. 1, partially in section.

Now referring to FIG. 2, the blowing device 14 is shown in greater detail. While the blowing device 14 may have any suitable form that results in flow along the coated layer 26 of the substrate 22, preferably the blowing device 14 includes the directing device 42 with a shape conforming to the periphery of the substrate 22. For utilization of the invention on tubular shaped photoreceptor drums, the preferred shape is a cylindrical ring through which the drum 22 may pass. The directing device 42 is preferably supported by a horizontal plate such as directing device support plate 44 which serves to orient the device 42 into a horizontal plane whereby the drum 22 may pass in a vertical direction.

The shop air generated by air compressors, not shown, may be fed to the directing device 42 by means of external tubes 46. The first end of the tubes 46 are connected to the blower 40 and the second end of the tubes 46 are connected via outlet fittings 56 to the directing device 42. It should be appreciated that the tubes 46 and fittings 52 and 56 may be partially or completely replaced by internal passageways, not shown, located in the directing device support plate 44. Air entering the directing device 42 via fittings 56 is directed to a gas outlet area 60 in a direction generally parallel to the drum 22.

Figure 3:
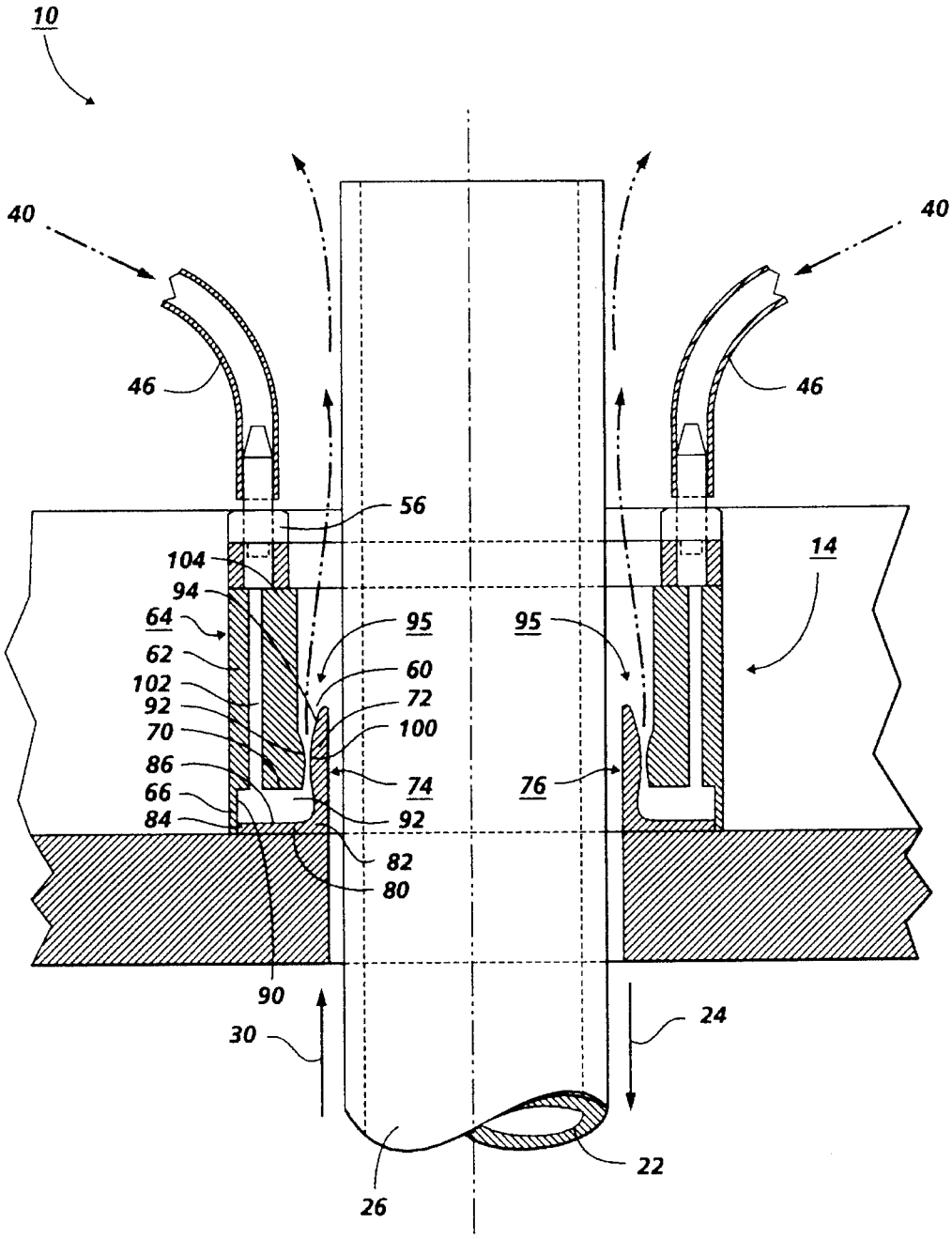
FIG. 3 is a partial elevational view of the peripheral drying ring as shown in FIG. 2, partially in section.

While the directing device 42 may be any suitable shape and construction method that provides for the proper direction of the air, preferably the device 42 has a two-piece construction as shown in FIG. 3. To simplify construction while maintaining uniform air flow conditions, a first piece 62 has a generally hollow cylindrical shaped portion 64. Preferably the first piece 62 has a ring shaped lip portion 66 which extends downwardly from one end 70 of the cylindrical portion 64. A second piece 72 has a cylindrical ring shaped first portion 74 which is slidably fitted within the bore 76 of the first piece 62. A hollow disc shaped flange 80 extends from one end 82 of the first portion 74 of the second piece 72. An outer periphery 84 of an inside face 86 of the flange 80 seats against an outer edge 90 of the lip portion 66, thereby forming a plenum or baffle 92 bounded by the end 70, the lip portion 66 and the flange 80.

The gas outlet area 60 is located downstream from the baffle 92 and is bounded by the bore 76 of the cylindrical portion 64 and an outer periphery 94 of the first portion of second piece 72. Preferably to provide for a smooth and accurately directed air flow, the space between the bore 76 and the periphery 94 are smoothly contoured to form a ring shaped nozzle 95, both surfaces having convex shapes. A point of inflection 96 of the bore 76 is aligned with a point of inflection 100 of the periphery 94. Air may be channeled from the fittings 56 to the baffle 92 in any suitable manner, but preferably the first piece 62 has axial channels 102 which lead from a second end 104 of the first piece 62 through to the end 70 so that air may flow from the fitting 56 through to the baffle 92. While the invention may be practiced with only one channel, to optimize air flow there are a plurality of equally spaced channels 102. Air flows from the blower 40, through the tubes 46, and then to the outlet fittings 56. Air then flows from the fittings 56, through the channels 102, and to the plenum, which serves to distribute the air evenly out the nozzle 95. Now referring to FIG. 4, substrate 22 in the form of a belt is shown after having been dipped so as to have formed thereon coated layer 26.

Again referring to FIG. 1, dipping device 12 causes substrate 22 to pass through a center of circumference blowing device 14 into coating solution 20 so that a coated layer 26 is formed thereon. Subsequently, dipping device 12 removes substrate 22 from coating solution 20 by moving substrate 14 in the removing direction 30 while passing through a center of circumference blowing device 14.

The circumference blowing device 14 serves to assist in the drying of the coated layer 26 after removal of the substrate 22 from the solution 20. Primarily this drying is assisted by convective heat transfer as the air is blown along the substrate 22. While this convective heat transfer may be effectively accomplished with ambient or cold air, depending on the operating temperatures and the chemical composition of the solution 20 and the substrate 22, the use of hot air may be desired. It will be appreciated that the air may be heated externally to the coating area. Likewise, referring to FIG. 4, the circumference blowing device 14 may advantageously include heaters 106 so that hot gas source 110 may supply relatively cold gas which is thereafter heated within circumference blowing device 14.

Figure 4:
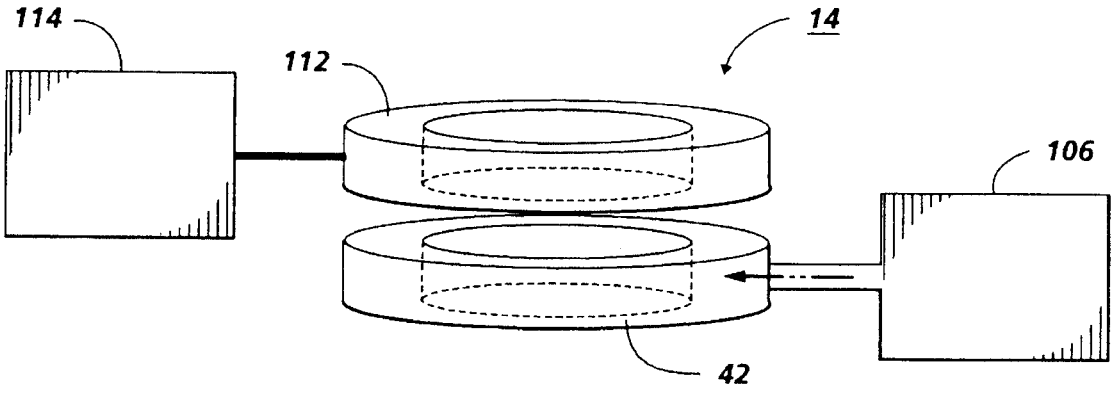
FIG. 4 is a perspective view of a thermal circumference dryer in combination with the peripheral drying ring of the present invention.

While convective heat transfer may be sufficient to adequately dry the substrate 22, inductive heat transfer may be desirable to assist in the drying. A circumferential induction heater such as a coil 112 as shown in FIG. 4 may be used to provide the inductive heat. Further, it will be appreciated that circumference blowing device 14 may be formed of a combined induction heater 112 and directing device 42, integrated as a single unit having two functions.

A second important effect of the circumference blowing device 14 of the present invention is that the gases passing through the outlet area 60 such as nozzle 95 assist in overcoming the effects of gravity on the fluid coating solution 20 in the coated layer 26. The upward air flow exerts an upward force on the solution 20. The flow is preferably regulated so that the upward force equalizes the downward force of gravity. Sag in the coating layer is thereby minimized resulting in a uniform coated layer 26.

Depending on the direction of the nozzle 95, a portion of the air flow may be normal to the substrate and impinge on the coated layer 26 so as to exert a gas pressure on the coated portion. The gas pressure from the gas stream passing through the nozzle 95 collect to form a collective pressure being uniformly applied across coated layer 26 along a transverse direction transverse to removing direction 30. This collective pressure squeezes the coating solution 20 which has adhered to substrate 22 as coated layer 26 so that as substrate 22 is removed in the removing direction 30 the squeezing action of the collective gas pressure squeezes the coated layer 26 to a uniform thickness free of defects. It will be appreciated that the nozzle may be replaced by any appropriately shaped aperture. It will be further appreciated that a circumference blowing device 14 may include at least one inductive heater 112 and at least one directing device 42 arranged so that as substrate 22 having coated layer 26 thereon is removed in the removing direction 30, the coated layer 26 first encounters directing device 42 supplied with gas from a relatively cold gas source under high pressure so as to squeeze the coated portion 31 to a uniform thickness, and then through an inductive heater 112, and then through a second directing device (not shown) supplied with gas from a relatively hot gas source.

Now referring to FIG. 4, circumference blowing device 14 includes inductive heater 112 and directing device 42. Inductive heater 112 is driven by inductive heater driver source 114, and directing device is supplied with hot gases from gas source 110. For example, hot air may be supplied.

Figure 5:
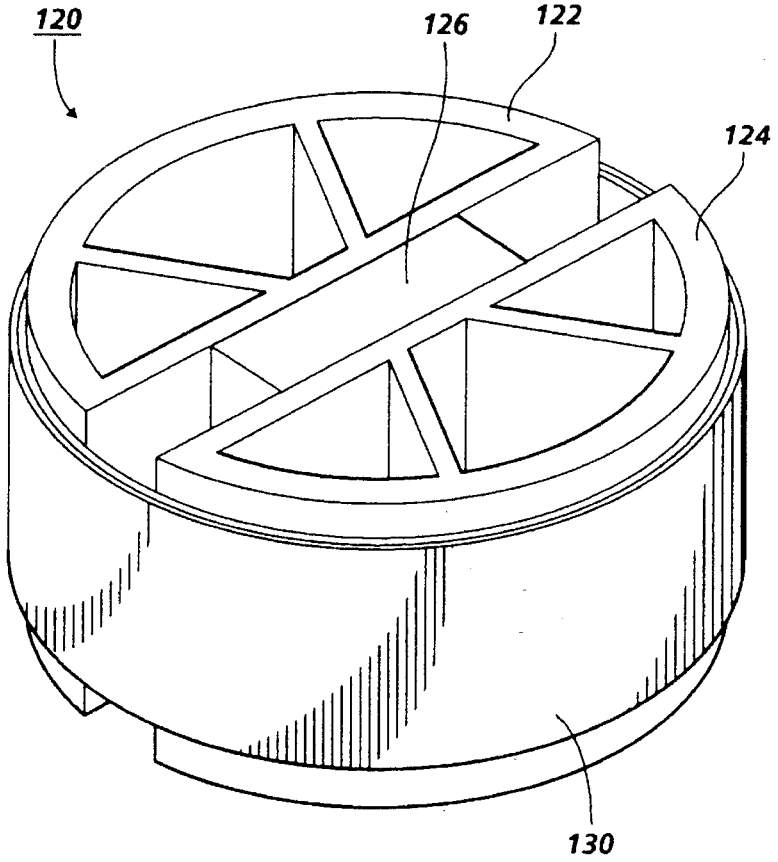
FIG. 5 is a perspective view of a belt frame for processing a flexible belt according to the present invention.

While the aforementioned application of the invention relates to coating cylindrical tubes, the invention could be practiced equally as well for coating belts. Referring to FIG. 5, belt frame 120 is shown to include first part 122, second part 124 and an expansion device 126 disposed between the first and second parts 122, 124. Flexible belt 130, such as a photoreceptor belt, is disposed around both first and second parts of the frame 120 and held snugly in place by expanding the expansion device 126. Thus, belt frame 120 having flexible belt 130 disposed therearound may be dipped into coating solution 20 by dipping device 12 according to the present invention. Flexible belt 130 and belt frame 120 form a rigid structure to withstand the collective pressure applied to the coating layer 26 by the pressure of the individual hot gas streams flowing through the nozzle 95.

While the invention may be practiced with a solitary dipping device 12 as shown in FIG. 1, for modern high volume production of coated substrates 22 such as photoreceptor tubes or belts, simultaneous coating of a lot of multiple substrates 22 is preferred.

The foregoing specification describes preferred embodiments of a novel method and apparatus for processing rigid drum and flexible belt charge receptors using an air foil air ring. The invention has been described with reference to the preferred embodiments thereof which are intended to be illustrative rather than limiting. Various changes in modifications may be made without departing from the spirit and scope of the invention as defined in the following claims.

It is claimed:

1. An apparatus for applying a photoconductive coating solution to at least a portion of a photoconductor substrate surface to form a coated surface, comprising:

means for placing the substrate into the coating solution;

means for separating the substrate from the coating solution; and means for creating a substantially vertical, upwardly oriented flow of gas onto the coated surface substantially in unison with said separating means separating the substrate from the coating solution, said creating means defining an aperture on the periphery thereof through which the flow of gas passes in an upward direction substantially parallel to the coated surface, so that the flow of gas suspends the coating solution during the drying of the solution to reduce sagging of the solution.

2. The apparatus of claim 1, wherein said separating means dips the substrate into the coating solution and removes the substrate therefrom.

3. The apparatus of claim 2, wherein said separating means comprise means for reciprocating the substrate in a substantially vertical direction into and out of the coating solution.

4. The apparatus of claim 3, wherein said creating means comprises:

means for blowing the gas; and a surface corresponding in contour to the substrate for directing the gas from said blowing means onto the coated surface.

5. The apparatus of claim 4, wherein said creating means comprises a manifold for uniformly distributing the gas around the coated surface.

6. The apparatus of claim 5, wherein said creating means comprise a conduit for transporting the gas, said conduit comprising an inner surface in confronting relationship with the coated surface, the inner surface defining an aperture through which the gas passes to uniformly dry the coated surface.

7. The apparatus of claim 6, wherein said blowing means generates a plurality of gas streams that flow through the aperture and exert a substantially upward pressure on the coated surface, with pressure from the gas streams being applied substantially uniformly on the coated surface resulting in a substantially uniform coating thickness while said reciprocating means removes the substrate from the coating solution.

8. The apparatus of claim 7, wherein said conduit comprises:

a cylindrically shaped first piece; and a ring shaped second piece, said first and second pieces being matingly fitted and having an annular contact area therebetween, with the aperture being defined by an annular minimal clearance area between said pieces, said manifold being defined by an area bounded by the annular contact area, said aperture, said first piece, and second piece.

9. The apparatus of claim 8, wherein the annular minimal clearance area of said conduit forms a nozzle having a contoured gas inlet area adjacent said manifold and a contoured gas outlet area opposite said manifold.

10. The apparatus of claim 6, wherein said conduit comprises:

a first portion of said conduit located downwardly from said aperture; and a second portion of said conduit located upwardly from said aperture, said second portion more closely fitting said substrate than said first portion.

11. The apparatus of claim 1 further comprising means for inductively heating the substrate surface while reciprocating means removes the substrate from the coating solution to uniformly dry an inner surface of the coated substrate.

12. A method for applying a photoconductive coating solution to at least a portion of a tubular photoconductor substrate to form a coated surface, the method comprising the steps of:

dipping the substrate into the coating solution;

removing the substrate from the coating solution; and creating a substantially vertical, upwardly oriented flow of gases spaced from the substrate and in a direction substantially parallel to the substrate and adjacent the coated surface of the substrate, substantially in unison with said removing step, so that the flow of gas suspends the coating solution during drying of the solution to reduce sagging of the solution.

13. The method of claim 12, wherein said creating step comprises blowing gases onto the coated surface.

14. The method of claim 13, wherein said blowing step comprises distributing the gases uniformly around the coated surface.

15. The method of claim 14, wherein said distributing step comprises squeezing the coated surface to a uniform thickness by substantially uniformly applying the gases to the periphery of the coated surface.

16. The method of claim 13, further comprising the step of inductively heating the substrate substantially in unison with said removing step to uniformly dry an inner surface of the substrate.

17. An apparatus for applying a photoconductive coating solution to at least a portion of a tubular substrate to form a coated photoconductor tube, comprising:

means for separating the substrate from the coating solution; and means for creating a substantially vertical, upwardly oriented flow of gas onto the tube substantially in unison with said separating means separating the substrate from the coating solution, said creating means including a directing device having a first surface and a second surface, said surfaces being opposed, arcuate, and smoothly contoured, said surfaces defining an aperture therebetween on the periphery thereof through which the flow of gas passes in an upward direction substantially parallel to the coated surface, so that the flow of gas is smooth, is accurately positioned and suspends the coating solution during the drying of the solution to reduce sagging of the solution.

18. The apparatus of claim 17, wherein at least one of said surfaces comprises a convex surface.

19. The apparatus of claim 17, wherein said directing device comprises:

a cylindrically shaped first piece, defining said first surface; and a ring shaped second piece defining said second surface, said first and second pieces being matingly fitted and having an annular contact area therebetween, with the aperture being defined by an annular minimal clearance area between said pieces.

20. The apparatus of claim 17, wherein said directing device defines a plenum adjacent the aperture for evenly distributing gas to the aperture.

* * * * *